United States Patent [19]

Stemmler

[11] Patent Number: 5,022,295

[45] Date of Patent: Jun. 11, 1991

[54] METHOD AND APPARATUS FOR MAINTAINING THE CUTTING CONDITIONS OF A ROTARY PUNCH CONSTANT

[75] Inventor: Kurt Stemmler, Neuweid, Fed. Rep. of Germany

[73] Assignee: Winkler & Dunnebier Maschinenfabrik und Eisengiesserei KG, Neuwied, Fed. Rep. of Germany

[21] Appl. No.: 442,477

[22] Filed: Nov. 22, 1989

Related U.S. Application Data

[63] Continuation of Ser. No. 239,693, Sep. 2, 1988, abandoned.

[30] Foreign Application Priority Data

Sep. 10, 1987 [DE] Fed. Rep. of Germany ..... 3730392

[51] Int. Cl.[5] ..... B26D 7/10; B26F 3/10; B41F 33/00

[52] U.S. Cl. ..... 83/16; 83/72; 83/171; 83/346; 83/508; 100/93 RD

[58] Field of Search ..... 83/16, 72, 74, 170, 83/171, 343, 346, 349, 495, 505, 507, 508; 101/216; 100/93 RP; 493/194, 195, 196, 208, 341

[56] References Cited

U.S. PATENT DOCUMENTS

| | | | |
|---|---|---|---|
| 2,866,392 | 12/1958 | Scarvelis | 493/208 |
| 3,064,563 | 11/1962 | Cook | 83/171 |
| 3,186,275 | 6/1965 | Obenshain | 83/170 |
| 3,587,377 | 6/1971 | Olson et al. | 83/171 |
| 4,148,236 | 4/1979 | Holoyen et al. | 83/171 |
| 4,233,011 | 11/1980 | Bolender et al. | 29/116.2 |
| 4,449,434 | 5/1984 | Johnson | 83/171 |
| 4,489,630 | 12/1984 | Okada et al. | 83/171 |
| 4,527,473 | 7/1985 | Littleton | 83/170 |
| 4,768,433 | 9/1988 | Boisseuain | 100/93 RP |

*Primary Examiner*—Douglas D. Watts
*Assistant Examiner*—Scott A. Smith
*Attorney, Agent, or Firm*—Collard, Roe & Galgano

[57] ABSTRACT

There is provided a method and apparatus for maintaining the cutting conditions constant at a rotary punch by bringing the rotary punch to a constant, predetermined temperature and maintaining the rotary punch at that temperature. Tempering elements are included in the rotary punch so as to maintain constant and set the spacing of the cylindrical envelope described by the cutting edge or edges from the opposing tool.

23 Claims, 2 Drawing Sheets

Figure 1:
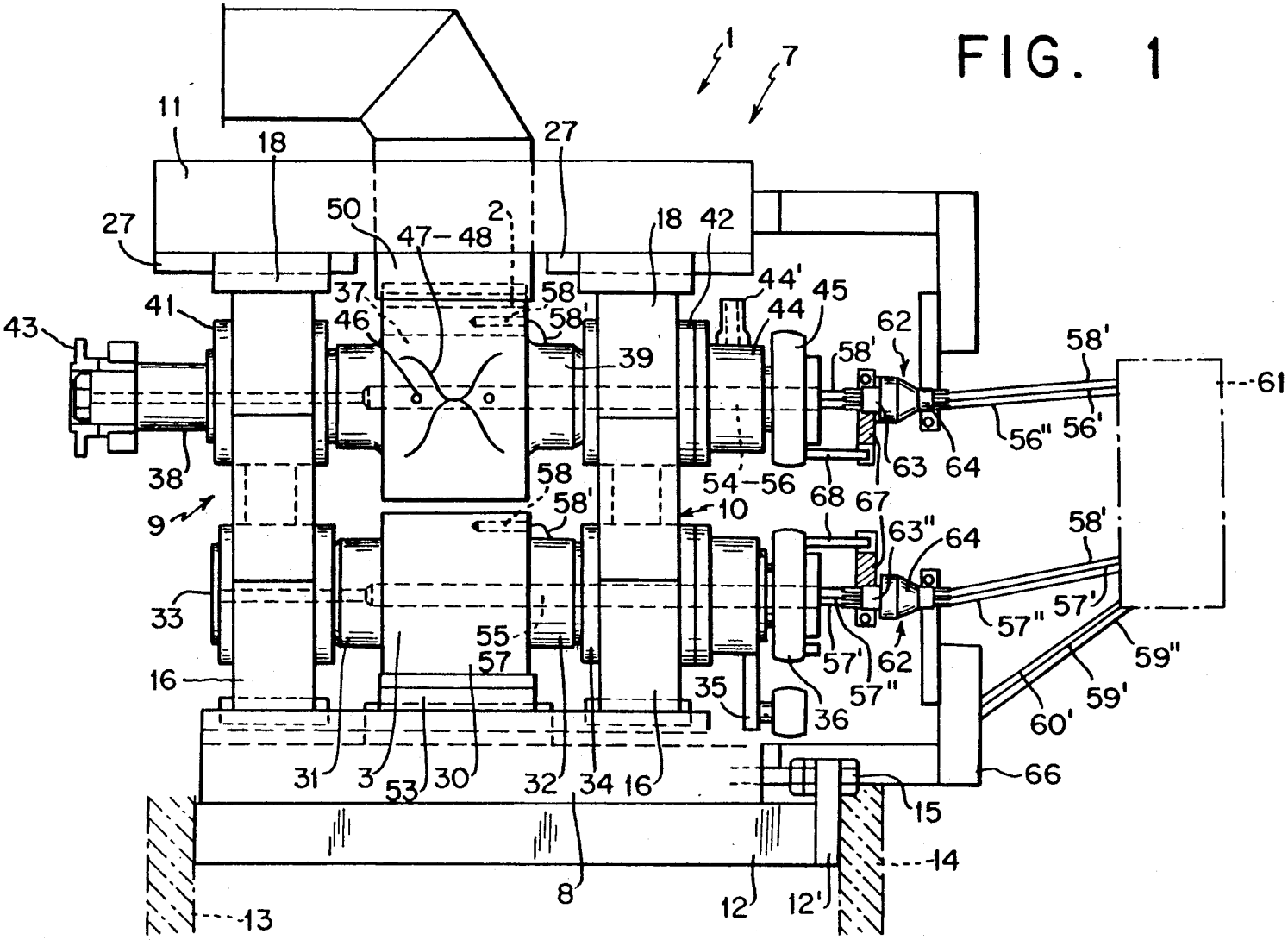

METHOD AND APPARATUS FOR MAINTAINING THE CUTTING CONDITIONS OF A ROTARY PUNCH CONSTANT

This is a continuation of application Ser. No. 239,693, filed Sept. 2, 1988, for "METHOD AND APPARATUS FOR MAINTAINING THE CUTTING CONDITIONS OF A ROTARY PUNCH CONSTANT", now abandoned.

The present invention relates to a method and apparatus for maintaining the cutting conditions constant of a rotary punch for producing profiled and straight cuts on moving webs or flat individual articles of foil or paper, particularly for manufacturing hygiene products, envelopes, flat bags or the like. The rotating cutting tool and a fixed or rotating opposing tool are arranged within a frame wherein the cutting edge or edges describe a cylindrical envelope and hit the opposing tool at the instant of the cut. The operating conditions of the rotary punch are such that an operating temperature dependent on the product and the environment is adopted.

Rotary punches of the above described type are well known. They are used widely, e.g., in the processing of paper and foils and in the manufacture of hygiene products, such as panty liners, sanitary napkins and the like. Their main members, the rotating cutting tool and the opposing tool, are arranged tangential to a working plane within a frame which comprises substantially a lower base plate, left and right side portions and an upper bridge. The cutting tool is generally cylindrically shaped and is provided with lateral bearing pegs by means of which it is mounted in roller bearing units. With the aid of these roller bearing units it is slidably received in the side portions of the frame and positioned and adjusted with a predetermined force with respect to the opposing tool. Either a stationary bar or a rotating roller may serve as the opposing tool. A stationary opposing tool is generally secured with a tool holder to the base plate while a rotating opposing tool, as in the case of the rotating cutting tool, is mounted in roller bearing units by means of which it is positionally fixedly received in the side portions of the frame.

Rotary punches of this type generally operate satisfactorily under normal temperature conditions. However, problems arise if precision cuts are to be performed under varying temperature conditions. In this connection it is immaterial whether these temperature conditions are caused by the processing of hot products or by varying ambient temperatures. Because of the disparate construction of the punching device by the use of different construction materials and different mass attachments, and because of the localized heat source, different and varied temperatures result within the punch device. Different temperatures and also different construction materials cause different thermal expansions in the rotary punch. Depending on the location of the warming, this results within the rotary punch to cutting failures or to the cutting and opposing tools hammering against one another thus resulting in increased wear of the tools and the necessity for frequent adjustment of the tool. This results finally in a considerable shorter service life of the tool. This is particularly serious if, when processing hot products, the cutting tool and the opposing tool are warmed faster and higher than the remaining parts of the rotary punch.

Various attempts have previously been made to solve this problem with rotary punches. One such attempt utilizes Schmitz rings, which are known from printing machine technology, to support the rotating cutting tool against the rotating opposing tool. The Schmitz rings have the principle object of preventing compensating movements between the cutting and opposing tools, as are caused by varying cutting and imbalance forces, and also to avoid incorrect settings of the cutting tool with respect to the opposing tool which result due to the action of heat and lead to the destruction of the cutting and opposing tools.

Such a rotary punch is disclosed in German Pat. document No. DE-GM-6602393. The punch therein serves to punch labels from adhesive paper. The cut may only be effected through the label paper into the adhesive layer and under no circumstances through the carrier paper. In order to ensure that this is the case, the diameter of the Schmitz rings in this construction are so selected that a free spacing of the thickness of the carrier paper is maintained between the effective cutting edge and the opposing roller.

Rotary punches equipped with Schmitz rings fulfill the duties required of them but only if one accepts considerable disadvantages. The most serious of these is that the axial spacing between the knife roller and opposing roller matching the inevitable wear of the knife can only be compensated for by complicated and time consuming grinding of the entire knife roller including the Schmitz rings. A substantial disadvantage of the Schmitz rings is that the opposing roller must be constructed as a rotating roller which rotates with the same peripheral velocity as the knife roller whereas it is often necessary for the best cutting results to stop the opposing roller or at least permit it to rotate slower than the knife roller. A factor weighing against the use of Schmitz rings is the effect of the considerable amount of dust which is produced when cutting paper. This dust is thermally deposited on the Schmitz rings and forces the cutting and opposing rollers apart, whereby not only the cutting action but also the service life of the bearings is unfavorably influenced.

In U.S. Pat. No. 3,186,275, to Obenshain, granted June 1, 1965, it is proposed that the lateral frame portions of a transverse cutter be warmed. For this purpose heating elements and temperature sensors, which are connected to a control device, are mounted on the lateral frame portions. Before the commencement of production, the temperature of the lateral frame portions in this transverse cutter are increased to approximately the temperature which obtains under production conditions due to the heating of the bearings. This results in the cutting conditions, when starting up after a long period of inactivity, being approximately the same as during normal production operation. Apart from the fact that roller bearing units are now available in which the problem referred to in the Obenshain patent does not arise, it is not possible with this pure transverse cutting device to perform shaped cuts on hot products. It is assumed in this patent that the cutting and opposing tools are not significantly warmed during operation and that only the cutting conditions when starting up after a long period of inactivity are to be improved. The described heating device thus has virtually no purpose after commencement of production. The transverse cutting device also has no facility either for determining the temperature on the cutting and opposing tools or for influencing them.

It is, therefore, the object of the present invention to provide a method, and apparatus suitable for carrying out the method, which permits the cutting conditions of a rotary punch to be maintained constant even at changing and differing temperatures and improving the service lives of the tools.

The above object is accomplished in accordance with the present invention by providing a method and apparatus for a rotary punch which produces profiled and straight cuts on moving webs or flat individual articles of foil or paper wherein the punching device is brought completely to a constant temperature, which is above the highest operating temperature which obtains under operating conditions, and is maintained at that temperature. The apparatus for accomplishing this method includes tempering means for the rotary punch so as to maintain constant and set the spacing of the cylindrical envelope described by the cutting edges of the cutting tool from the opposing tool. As a result of this feature the negative influence of the unchecked thermal expansion is eliminated and thus the tool service life, the operational reliability and finally also the ease of service are substantially increased.

An unexpected further advantage resulting from the present invention is that by means of the controlled, individual temperature increase at the cutting and opposing tools, a sensitive adjustment in response to wear which enhances the service life of the tool is possible.

Other objects and features of the present invention will become apparent from the following detailed description considered in connection with the accompanying drawings. It is to be understood, however, that the drawings are designed as an illustration only and not as a definition of the limits of the invention.

Figure 2:
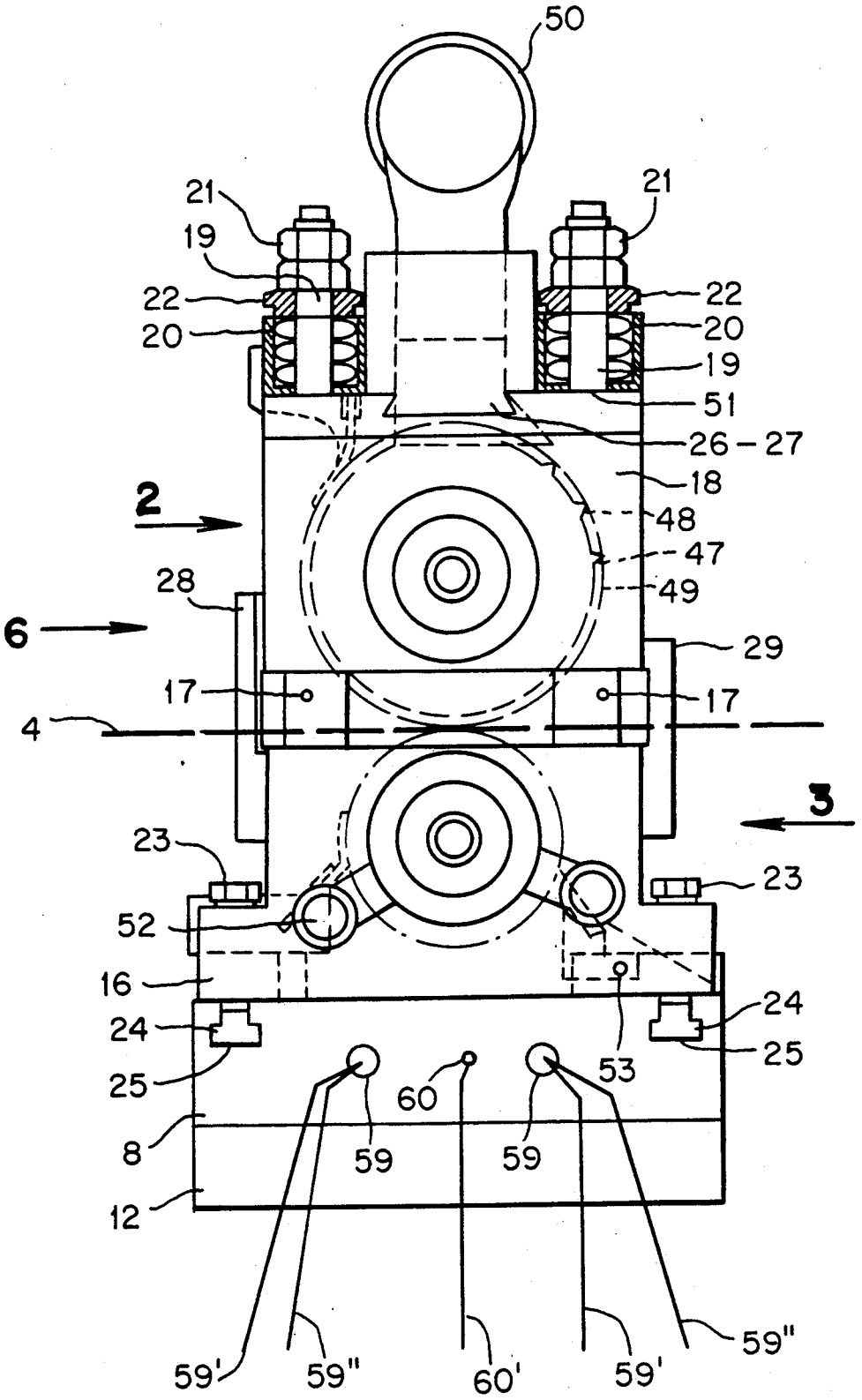

In the drawings, wherein similar reference characters denote similar elements throughout the several views:

FIG. 1 schematic front elevational view of a rotary punch rotating opposing tool incorporating the present invention; and FIG. 2 is a schematic side elevational view of the rotary punch of FIG. 1.

Now turning to the drawings, FIGS. 1 and 2 show a rotary punch 1 for performing shaped severing cuts in the manufacture of sanitary napkins and panty liners. Rotary punch 1 consists of a cutting tool 2 which operates against an opposing tool 3, passing between which in the direction of travel 6 is a product path 4 which defines a working plane 5. Both cutting tool 2 and opposing tool 3 are constructed as cylindrical rollers and are referred to below as cutting roller 2 and opposing roller 3, respectively. Cutting and opposing rollers 2 and 3 are arranged so as to be tangential to working plane 5 within a frame 7. Frame 7 consists of a base plate 8, a left side portion 9, a right side portion 10 and an upper bridge 11. Base plate 8 of frame 7 rests on a transverse beam 12 which is fastened between machine frames 13 and 14 of the production machine. Frame 7 is movable transerve to the direction of travel 6 by means of an adjustment spindle 15 whose thread engages in base plate 8 and which is rotatably mounted in a nose 12' of transverse beam 12. Frame 7 is fixed to transverse beam 12 with the aid of fastening elements (not shown). Side portions 9 and 10 are constructed from the same elements. An upper bearing block 18 is positioned above a lower bearing block 16 and spaced therefrom by spacer rings 17. Vertical rods 19, which are screwed into the lower bearing block 16 from above, pass through spacer ring 17 and the upper bearing block 18 and hold the latter in the correct position but vertically movable with respect to the lower bearing block 16. Threaded onto the upper ends of rods 19 and resting on the upper surface of upper bearing block 18 are plate spring packets 20 which are urged aginst upper bearing block 18 by means of nuts 21 and pressure discs 22. Lower and upper bearing blocks 16 and 18 and spacer rings 17 are pressed together with a predeterminable force with the aid of plate spring packets 20. Lower bearing blocks 16 of side portions 9 and 10 are each movably secured to base plate 8 with screws 23 and goove blocks 24 which are received in T grooves 25 in base plate 8. Upper bearing blocks 18 of side portions 9 and 10 have a swallow-tail or dovetail shaped goove 26 with which they engage around a correspondingly shaped guide 27 formed on upper bridge 11. Secured to the sides of lower bearing blocks 16 are lugs 28 and 29 which hold upper bearing blocks 18 in the correct position in the direction of travel 6.

Opposing roller 3 has a cylindrical base body 30 with bearing pegs 31 and 32 connected thereto which rotatably mount opposing roller 3 in left-hand and right-hand roller bearing units 33 and 34 which in turn are received in lower bearing block 16. Right-hand bearing peg 32 extends through right-hand roller bearing unit 34 and through a belt tensioner 35 pivotally secured thereto and carries a belt pulley 36 at its right-hand end. Cutting roller 2 also has a cylindrical base body 37 and left-hand and right-hand bearing pegs 38 and 39 coaxially connected thereto. Cutting roller 2 is rotatably mounted by means of bearing pegs 38 and 39 in left-hand and right-hand roller bearing units 41 and 42 which are received in upper bearing block 18. Left-hand bearing peg 38 extends through left-hand roller bearing unit 41 and carries a clamping flange 43 at its left-hand end. Connectable to clamping flange 43 is a drive shaft (not shown) which connects cutting roller 2 to a main drive (not shown) of the production machine. Right-hand bearing peg 39 extends through right-hand roller bearing unit 42 and at its right-hand end carries a vacuum control valve 44 and a belt pulley 45. Belt pulley 45 is secured in alignment with belt pulley 36 on bearing peg 39. By means of a flat belt (not shown) it transfers the rotational drive to belt pulley 36. The flat belt is thus tensioned by belt tensioner 35 and so deflected that the directions of rotation of cutting and opposing rollers 2 and 3 are in the opposite sense corresponding to the direction of travel 6. Vacuum control valve 44 is in air-conducting communication with vacuum outlets 46 arranged in base body 37 by way of bores (not shown) arranged in cutting roller 2. It has a connecting pipe 44 through which vacuum is supplied from a vacuum source (not shown). Vacuum control valve 44 itself is not described in detail since it is well known in the prior art and not important for the present invention. Arranged on cylindrical base body 37 of the cutting roller are cutting blades 47 whose cutting edges 48 describe a cylindrical envelope 49 during rotation and hit opposing roller 3 at the instant of the cut. The spacing of the rotational axes of cutting and opposing rollers 2 and 3 is so selected and fixed by means of spacer ring 17 and adjustment wedges (not shown) that cutting edges 48 of cutting roller 2 grazingly contact cylindrical base body 30 of opposing roller 3.

Arranged above cutting roller 2 and passing through upper bridge 11 is a vacuum hopper 50. Trimmings, waste, cut out and away from product web 4 are sucked on cutting roller 2 onto vacuum outlets 46, transported to vacuum hopper 50 and removed through it. As additional devices rotary punch 1 has moistening devices 51 and 52, respectively, for cutting and opposing rollers 2 and 3 and a wiper device 53 for cleaning opposing roller 3.

The rotary punch has different elements and devices for the tempering process in accordance with the invention. The heating elements used for this purpose are termed heating cartridges hereafter. Heating cartridges 56 and 57 are accommodated both within cutting roller 2 and also within opposing roller 3 in coaxially disposed longitudinal bores 54 and 55. Cutting and opposing rollers 2 and 3 also have internal temperature sensors 58 which are arranged in respective bores near to the working outer periphery. Two heating cartridges 59 and a temperature sensor 60 are also arranged in base plate 8. The capacity of heating cartridges 56, 57 and 59 is arranged to be in accordance with the necessary thermal energy requirement. Heating cartridges 56, 57 and 59 and temperature sensors 58 and 60 are connected by means of lines 56', 56'', 57', 57'', 59', 59'' and 58', 60'' to a control device 61 stationarily disposed outside rotary punch 1 and are controlled thereby in accordance with predetermined parameters. Heating cartridges 59 and temperature sensor 60 in plate 8 are connected by means of continuous lines 59', 59'' and 60' to control device 61. By contrast, slip-ringless wear-free operating connecting elements 62 are incorporated in lines 56', 56'' and 58', which come from rotating cutting roller 2, and in lines 57', 57'', and 58', which come from rotating opposing roller 3 and lead to stationary control device 61. Each connecting element 62 consists of a rotary inner portion 63 and a stationary outer portion 64 each having a contact set cooperating with one another. Stationary outer portion 64 of connecting elements 62 are secured to frame 7 by means of clamping holders 65 and 66 in such a manner that rotary inner portions 63 are aligned coaxially with cutting roller 2 or opposing roller 3. Each rotary inner portion 63 carries a respective clamped on engagement member 67. Screwed into belt pulley 45 of cutting roller 2 and into belt pulley 36 of opposing roller 3 is a respective peg 68 which transmits the rotary motion to respective inner portion 63.

During the production operation, cutting edges 48 of cutting roller 2 penetrate into product web 4 in the working cycle of the production machine, separate them into individual articles and cut scraps from them. These scraps are retained, as described above, by means of vacuum on cutting roller 2 and transported to vacuum hopper 50 and removed through it. When processing hot material, cutting and opposing rollers 2 and 3 heat up. This is particularly the case if a shaped severing cut is to be effected in zones of the product web which have been hot stamped immediately beforehand, e.g., in the manufacture of panty liners and sanitary napkins. Wiping device 53 is also to be considered as a further heat source which is pressed in dependence on the product to a greater or lesser degree against opposing roller 3 and thus produces frictional heat. The heat arising due to bearing friction in roller bearing units 33, 34, 41, 42 can be ignored having regard to the heat sources mentioned above.

By means of heating cartridges 56, 57, 59 the entire punching device 1 is brought to and maintained at an adjustable, predeterminable temperature which is as high as or greater than the highest operating temperature which obtains under operational conditions without tempering. The temperature values which are adopted are determined at the most important points of the rotary punch 1 by temperature sensors 58 and 60 and transferred to control device 61. This then initiates the necessary supply of electric energy to heating cartridges 56, 57, 59. It has proved to be advantageous to bring rotary punch 1 to a temperature level which is slightly above the highest operating temperature and to hold it there. By the use of this feature a constant temperature level and thus also constant cutting conditions can be easily achieved by the controlled supply of thermal energy.

In addition, heating cartridges 70 with associated temperature sensors 71 may be installed in upper bridge 11, and lines 70', 70'' and 71' are connected to control device 61 therefrom. Also, heating elements 72 with associated temperature sensors 73 may be installed on side portions 9 and 10 respectively, and respective lines 72', 72'' and 73'' therefrom are connected to control device 61.

A sensitive wear adjustment in the micro meter range should also be mentioned and described as a further possibility of utilizing the apparatus in accordance with the invention. This wear adjustment could previously be effected only coarsely with adjustment wedges (not shown) arranged within the upper bearing blocks 18 so as to be displaceable and acting against the spacing ring 17. If, by reason of wear at the cutting edges 48, cutting failures or cutting errors occur, the temperature at the cutting and opposing rollers 2 and 3 is increased in a controlled manner. Due to the consequent thermal expansion, the spacing between opposing roller 3 and cylindrical envelope 49 described by cutting edges 48 is reduced to a desired value and the cuts are again performed reliably. In a further development of the invention the wear adjustment is automatically performed after a predetermined number of cuts by means of controller increase of the temperature at the cutting and opposing rollers 2 and 3.

While only a single embodiment of the present invention has been shown and described, it will be obvious that many changes and modifications may be made thereunto without departing from the spirit and scope of the invention.

What is claimed is:

1. A method of maintaining constant a set of cutting conditions at a rotary punch for producing profiled and straight cuts on moving webs or flat individual articles of foil or paper particularly for manufacturing hygiene products, envelopes, flat bags or the like, by means of a rotating cutting tool having a longitudinal bore and a working outer periphery and a fixed or rotating opposing tool having a longitudinal bore and a working outer periphery which are arranged within a frame, wherein a cutting edge or edges are on said working outer periphery of said cutting tool and describe a cylindrical envelope and hit the opposing tool at the instant of the cut and wherein under operating conditions the rotary punch operating temperature dependent on the product and on the environment results, said method comprising monitoring in a bore near to said working outer periphery of said cutting and opposing tools and controlling the heating of the rotary punch by thermal conduction to an adjustable and predeterminable constant temperature, by means of heat sources, coaxially disposed in said longitudinal bores, said constant temperature being no less than the rotary punch operating temperature which results under operating conditions;

adjusting the space of the cylindrical envelope described between the cutting tool and the opposing tool so as to set the cutting conditions thereof;

maintaining the rotary punch at said temperature;

wherein the opposing tool is heated and the heating of the cutting tool and the opposing tool is by means of integrated heating elements coaxially disposed in said longitudinal bores and the temperature is monitored by means of integrated heat sensors in a bore near to said working outer periphery of said cutting and opposing tools; and wherein the temperature is controlled by a common, stationary control device which is connected with all the heating elements and temperature sensors.

2. The method as claimed in claim 1, wherein the rotary punch frame has a base plate and the method further includes heating said base plate by means of at least one integrated heating element, and monitoring the temperature by means of an integrated temperature sensor.

3. The method as claimed in claim 1, wherein the rotary punch frame has side portions and the method further includes heating said side portions by means of heating elements, and monitoring the temperature by means of integrated temperature sensors.

4. The method as claimed in claim 1, wherein the rotary punch frame has an upper bridge and the method further includes heating said upper bridge by means of at least one integrated heating element, and monitoring the temperature by means of an integrated temperature sensor.

5. The method as claimed in claim 1 wherein the temperature of the cutting and opposing tools are increased by a monitored amount so as to maintain a cut position.

6. The method as claimed in claim 5, which further comprises automatically effecting a wear adjustment after a predetermined number of cuts by means of a monitored increase of the temperature of the cutting tool and opposing tool.

7. Apparatus for maintaining constant a set of cutting conditions at a rotary punch for producing profiled and straight cuts on moving webs or flat individual articles of foil or paper, particularly for manufacturing hygiene products, envelopes, flat bags or the like, by means of a rotating cutting tool having a longitudinal bore and a working outer periphery and a fixed or rotating opposing tool having a longitudinal bore and a working outer periphery which are arranged within a frame, wherein the cutting edge or edges are on said working outer periphery of said cutting tool and describe a cylindrical envelope and hit the opposing tool at the instant of the cut and wherein under operating conditions a rotary punch operating temperature dependent on the product and the environment results, said apparatus comprising an integrated heating element coaxially disposed in said longitudinal bore of said cutting tool and an integrated temperature sensor included in a bore near to said working outer periphery of said rotary punch;

an integrated heating element coaxially disposed in said longitudinal bore of said opposing tool and an integrated temperature sensor included in a bore near to said working outer periphery of said opposing tool for tempering so as to maintain constant and set the spacing of the cylindrical envelope described by the cutting edge or edges from the opposing tool;

said tempering resulting in a temperature of said rotary punch which is no less than the rotary punch operating temperature which results under operating conditions; and means for adjusting the spacing of the cylindrical envelope described by the cutting edge or edges from the opposing tool so as to set the cutting conditions thereof subsequent to the tempering of the rotary tool and opposing tool.

8. The apparatus as claimed in claim 7, wherein said frame includes a base plate which has means for tempering.

9. The apparatus as claimed in claim 8, wherein said base plate has at least one integrated temperature sensor, and at least one integrated heating element which are connected to a control device by means of lines.

10. The apparatus as claimed in claim 7, wherein said heating element of said rotary punch is an electrically operated heating cartridge.

11. The apparatus as claimed in claim 10, wherein said heating cartridge is coaxially arranged in the rotating cutting tool.

12. The apparatus as claimed in claim 7, wherein said heating element of said opposing tool is an electrically operated heating cartridge.

13. The apparatus as claimed in claim 12, wherein said heating cartridge is coaxially arranged in the rotating opposing tool.

14. The apparatus as claimed in claim 7, wherein said integrated temperature sensor of said cutting tool is arranged near to the working outer shell of the cutting tool.

15. The apparatus as claimed in claim 7, wherein said integrated temperature sensor of said opposing tool is arranged near to the working outer shell of the opposing tool.

16. The apparatus as claimed in claim 7 wherein a slip-ringless, wear-free operating connecting element is connected in lines between the rotating cutting tool on the one hand and a control device on the other hand.

17. The apparatus as claimed in claim 7 wherein a slip-ringless, wear-free operating connecting element is connected in lines between the rotating opposing tool on a one hand and the control device on the other hand.

18. The apparatus as claimed in claim 7, wherein said frame has means for tempering.

19. The apparatus as claimed in claim 18, wherein each side portion of the frame has at least one heating element and at least one integrated temperature sensor which are connected to a control device by means of lines.

20. The apparatus as claimed in claim 7, wherein said frame has an upper bridge which has means for tempering.

21. The apparatus as claimed in claim 20, wherein said upper bridge of the frame has at least one integrated heating element and at least one integrated temperature sensor which are connected to a control device by means of lines.

22. A method of maintaining constant a set of cutting conditions at a rotary punch for producing profiled and straight cuts on moving webs or flat individual articles of foil or paper particularly for manufacturing hygiene products, envelopes, flat bags or the like, by means of a rotating cutting tool having a longitudinal bore and a fixed or rotating opposing tool having a longitudinal bore which are arranged within a frame, wherein a cutting edge or edges on the cutting tool describe a cylindrical envelope and hit the opposing tool at the instant of the cut and wherein under operating conditions a rotary punch operating temperature dependent on the product and on the environment results, said method comprising monitoring and controlling the heating of the rotary punch by thermal conduction to an adjustable and predeterminable constant temperature, by means of heat sources, coaxially disposed in said longitudinal bore of said cutting tool, said constant temperature being no less than the rotary punch operating temperature which results under operating conditions;

adjusting the space of the cylindrical envelope described between the cutting tool and the opposing tool so as to set the cutting conditions thereof;

maintaining the rotary punch at said temperature;

wherein the opposing tool is heated and the heating of the cutting tool and the opposing tool is by means of integrated heating elements coaxially disposed in said longitudinal bores, and the temperature is monitored by means of integrated heat sensors; and wherein the temperature is controlled by a common, stationary control device which is connected with all the heating elements and temperature sensors, wherein said rotating cutting tool has a working outer periphery and said opposing tool has a working outer periphery; Wherein said cutting edge or edges are on said working outer periphery of said cutting tool; and monitoring the temperature of the cutting tool and the opposing tool by said integrated heat sensors in bores near to said working outer periphery of said cutting and opposing tools.

23. Apparatus for maintaining constant a set of cutting conditions at a rotary punch for producing profiled and straight cuts on moving webs or flat individual articles of foil or paper, particularly for manufacturing hygiene products, envelopes, flat bags or the like, by means of a rotating cutting tool having a longitudinal bore and a working outer periphery and a fixed or rotating opposing tool having a longitudinal bore which are arranged within a frame, wherein a cutting edge or edges on the cutting tool describe a cylindrical envelope and hit the opposing tool at the instant of the cut and wherein under operating conditions a rotary punch operating temperature dependent on the product and the environment results, said apparatus comprising an integrated heating element coaxially disposed in said longitudinal bore of said cutting tool and an integrated temperature sensor included in said rotary punch;

an integrated heating element coaxially disposed in said longitudinal bore of said opposing tool and an integrated temperature sensor included in said opposing tool for tempering so as to maintain constant and set the spacing of the cylindrical envelope described by the cutting edge or edges from the opposing tool;

said tempering resulting in a temperature of said rotary punch which is no less than the rotary punch operating temperature which results under operating conditions; and means for adjusting the spacing of the cylindrical envelope described by the cutting edge or edges from the opposing tool so as to set the cutting conditions thereof subsequent to the tempering of the rotary tool and opposing tool, wherein said rotating cutting tool has a working outer periphery and said opposing tool has a working outer periphery; wherein said cutting edge or edges are on said working outer periphery of said cutting tool; and said integrated temperature sensors are located in bores near to said working outer periphery of said cutting tool and said opposing tool for monitoring the temperature of said cutting tool and said opposing too.

* * * * *